United States Patent [19]

Christ et al.

[11] 4,451,739

[45] May 29, 1984

[54] CONTAINER FOR RADIOACTIVE MATERIALS

[76] Inventors: Richard Christ, August-Bebel-Strasse 20, 6454 Bruchköbel; Hartmut Kroll, Gaussstrasse 6, 6450 Hanau, both of Fed. Rep. of Germany

[21] Appl. No.: 240,379

[22] Filed: Mar. 4, 1981

[30] Foreign Application Priority Data

Mar. 8, 1980 [DE] Fed. Rep. of Germany ..... 3008992

[51] Int. Cl.[3] ..... G21F 5/00; G21F 3/00

[52] U.S. Cl. ..... 250/506.1; 250/515.1; 376/272

[58] Field of Search ..... 250/506, 515; 376/272

[56] References Cited

U.S. PATENT DOCUMENTS

| | | | |
|---|---|---|---|
| Re. 29,876 | 1/1979 | Reese | 250/506.1 |
| 2,935,616 | 5/1960 | Smith et al. | 250/506.1 |
| 3,016,463 | 1/1962 | Needham | 250/506.1 |
| 3,252,692 | 5/1966 | Langa | 250/515.1 |

*Primary Examiner*—Alfred E. Smith
*Assistant Examiner*—Jack I. Berman
*Attorney, Agent, or Firm*—Cushman, Darby & Cushman

[57] ABSTRACT

Containers for the transportation and/or storage of radioactive materials, particularly irradiated fuel elements needing a shielding for keeping back the radioactive rays. Previously known shieldings cannot be adjusted optimally to the activity of the material being transported. A good adjustment can be attained by applying the shielding entirely or partially as metal casing on the container.

7 Claims, 4 Drawing Figures

CONTAINER FOR RADIOACTIVE MATERIALS

BACKGROUND OF THE INVENTION

The invention is directed to a container having a variable shielding and the necessary equipment for the transportation and/or the storage of radioactive materials, especially of irradiated fuel elements from nuclear reactors.

For the transportation and storage of irradiated or spent fuel elements from nuclear reactors there are needed containers which retain the radioactivity of the materials. Therefore there are severe requirements in the construction of there containers, above all those which concern the industructability of the container in accidents and the protection of the environment from radioactive rays. Therefore the container for the transportation and storage of irradiated fuel elements must be constructed stable and strong and must offer a protection form radioactive rays. Thereby, however, the material for the radioactive shielding should be so selected that the weight of the shielding which makes up the greatest part of the weight of the transportation container, for economical reasons is held as small as possible. Besides attention must be paid that the heat of decay of the transported or stored fuel elements can be safely drawn off to the outside.

The shielding of the container must retain the entire biologically active radiation, which preferably is done by means of a jacket made of uranium, lead, or steel which above all, absorbs the gamma radiation. Additionally, there is the neutron shielding which usually is applied between the cooling flanges, occasionally also, in channels of the container support.

A disadvantage of known container shielding is that the thickness of the shielding against the radioactive gamma radiation corresponds to the maximum case provided for the transportation or storage. However, in a large part of the transportation and in employment as storage container, e.g. spent fuel elements are contained which are already so far faded away in the fuel element storage basins of the nuclear power plant that in these cases the shielding is over-dimensioned. In such cases, there thus results unnecessarily high costs of production and transportation. Therefore it has already been proposed to apply hollow bodies filled with neutron shielding material and providing cooling flanges to an impervious container base. However, there is the disadvantage that while there is attained a variance in the withdrawal of heat and in given case in the neutron shielding there is practically nil in the shielding against gamma radiation.

Furthermore, there are also known two-part shielding containers which consist of a relatively simply constructed thin walled inner container having barrier functions which is located interchangeably in an outer container having shielding functions and having cooling flanges whereby according to the radioactive inventory of the inner container there is used another outer container designed in each case for the radioactive inventory. However, the considerable difficulties resulting from the reloading as well as the high costs of the numerous heavy and expensive outer containers which must be furnished.

Therefore it was the problem of the present invention to provide a container having a variable shielding and necessary equipment for the transportation and/or the storage of radioactive materials, especially irradiated fuel elements from nuclear reactors which make possible in a simple manner the variation of the shielding, preeminently from gamma radiation.

SUMMARY OF THE INVENTION

This problem is solved according to the invention by applying the shielding entirely or partially as a metal casing on the container.

The containers of the invention can comprise, consist essentially of or consist of the stated elements.

DETAILED DESCRIPTION

Figure 1:
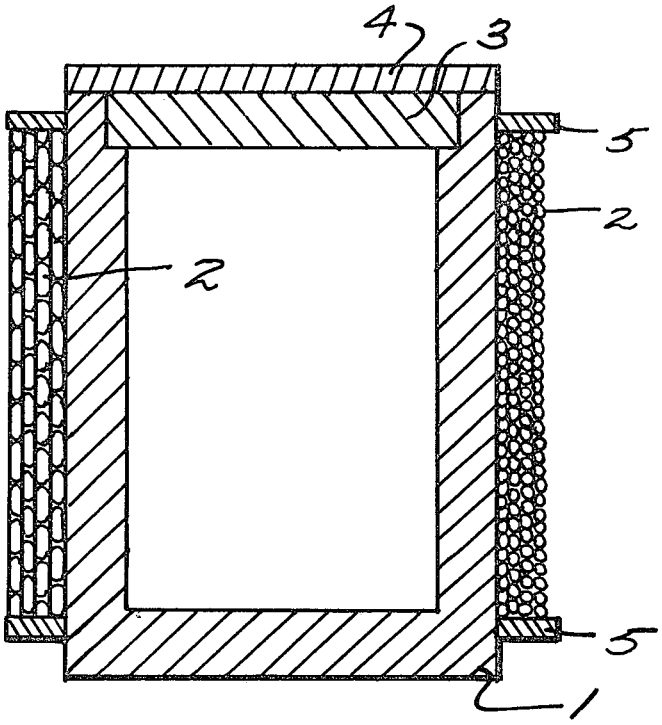
FIG. 1 is a schematic representation of one form of container according to the invention.
Figure 2:
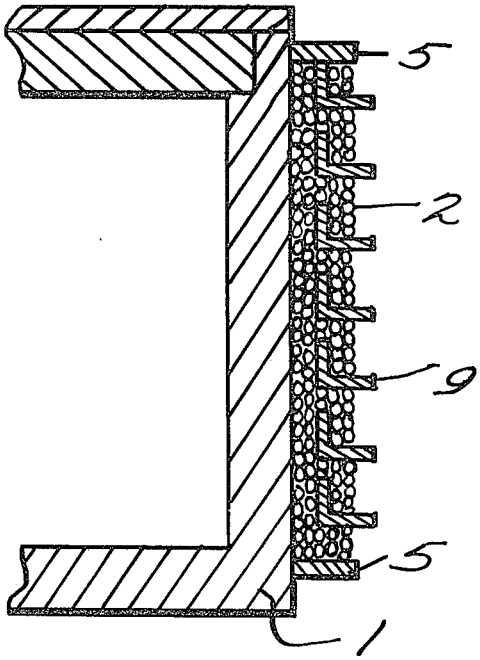
FIG. 2 is a schematic partial view of another form of container according to the invention.
Figure 3:
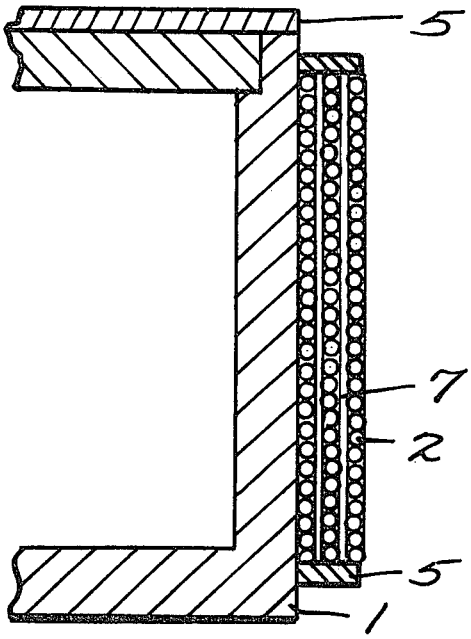
FIG. 3 is a schematic partial view of an alternative form of the invention.
Figure 4:
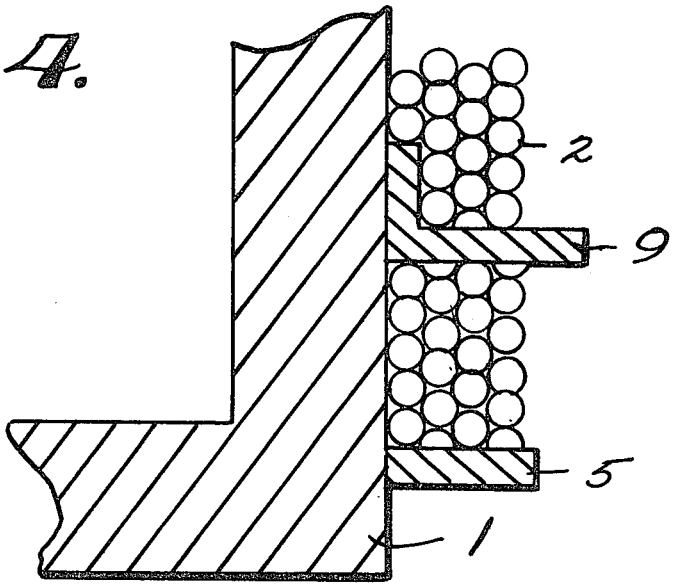
FIG. 4 is a schematic partial view of still another form of the invention.

Referring more specifically to the drawings where like numerals refer to like parts, the container 1 is provided with a shielding cover 3 and an outer cover 4, presenting the tight enclosure for the radioactive material found therein. The container jacket is encased by a metal casing 2, e.g. of steel, which has the function of shielding against gamma radiation. For adjustment to the radioactive content the metal casing 2 is applied in certain cases in multilayer form. The casing 2 is relatively simple to apply or remove by rotation of the container 1. There are suited as casing 2 metal tapes of good gamma-absorbing material, especially steel. It is particularly desirable to use for the metal casing 2 wires or cables. In certain cases the metal casing 2 can be applied between the cooling fins or flanges 9 which in a given case are located on the container. However, it is especially advantageous to secure loose cooling flanges, preferably of angle-shaped sheets 9, by partially encasing them with the metal casing 2. It has proven particularly favorable to confine the metal casing on the side by the sheets 5 secured to the container. In special cases it is also favorable to detachably fix the sheets 5, encased according to the book support principle by loading with the metal casing 2. That is to say, the sheets 5 will have feet engaging the exterior surface of the container as do the angle-shaped sheets 9 so that the wires or cables will engage the foot section to hold the sheet 5 in place.

Advantageously the hollow space 7 present in the metal casing 2 is filled with neutron shielding material. For this above all, there are employed castable curable synthetic resins having neutron shielding properties. In a particularly advantageous variant layers of neutron shielding materials, e.g. films or mats are encased in the metal casing. The ends of the metal casing 2 can be fixed by clamps, screws, or other methods either on the container 1, or on its auxiliary equipment or by fastening on the casing itself.

The container of the invention makes possible in a surprisingly simple and effective manner the adjustment of the gamma rays shielding to the irradiation inventory found in each case.

What is claimed is:

1. A container for radioactive material having an interior for receiving radioactive material and an exterior surface, at least part of said exterior surface having gamma ray absorbing means removably mounted thereon to a depth sufficient to absorb gamma radiation from the radioactive material disposed within said container, said gamma ray absorbing means comprising wire means wrapped around the exterior surface of said container with a plurality of wraps, and said container also being provided with cooling flanges which are at least partially embedded in said wire means.

2. The container of claim 1 wherein said wire is steel wire.

3. The container as claimed in claim 1 wherein said metal layers are confined between sheets adjacent the top and bottom of said container.

4. The container as claimed in claim 1 wherein there are hollow spaces between said layers of metal and said hollow spaces are filled with neutron shielding material.

5. The container as claimed in claim 4 wherein said neutron shielding material is in the form of mats or films.

6. A method of shielding a container for radioactive material, the container being of the type having an interior for receiving the radioactive material and an exterior surface, the method comprising the steps of wrapping the exterior surface with metal wire to a thickness sufficient to absorb gamma radiation from the radioactive material disposed within said container.

7. The method as claimed in claim 6 including the step of providing hollow spaces between the wrapped wires and filling the hollow spaces with neutron absorbing material.

* * * * *